US008348090B2

(12) United States Patent
Crager et al.

(10) Patent No.: US 8,348,090 B2
(45) Date of Patent: Jan. 8, 2013

(54) METAL INSERT FITTING FOR MATERIAL STORAGE TANKS

(75) Inventors: David L. Crager, Auburn, IN (US); Douglas J. Murphy, Marshall, TX (US)

(73) Assignee: ROTO Engineering GmbH, Frankfurt am Main (DE)

( * ) Notice: Subject to any disclaimer, the term of this patent is extended or adjusted under 35 U.S.C. 154(b) by 99 days.

(21) Appl. No.: 13/083,888

(22) Filed: Apr. 11, 2011

(65) Prior Publication Data

US 2011/0247956 A1 Oct. 13, 2011

Related U.S. Application Data

(60) Provisional application No. 61/323,146, filed on Apr. 12, 2010.

(51) Int. Cl.
*B65D 6/40* (2006.01)

(52) U.S. Cl. ..... 220/661; 220/4.13

(58) Field of Classification Search ..... 220/4.12, 220/4.13, 565, 582, 661, 675, 676; 222/501, 222/520; 137/577.5
See application file for complete search history.

(56) References Cited

U.S. PATENT DOCUMENTS

| | | | | |
|---|---|---|---|---|
| 2,455,311 | A | | 11/1948 | Meyers et al. |
| 3,206,075 | A | * | 9/1965 | Scholle ..... 222/105 |
| 3,587,637 | A | | 6/1971 | Coleman |
| 3,610,457 | A | | 10/1971 | Opalewski |
| 4,143,193 | A | | 3/1979 | Rees |
| 4,342,799 | A | | 8/1982 | Schwochert |
| 4,492,392 | A | | 1/1985 | Woods et al. |
| 4,536,116 | A | | 8/1985 | Murray |
| 4,625,892 | A | | 12/1986 | Carlin, Jr. |
| 4,660,733 | A | | 4/1987 | Snyder et al. |
| 4,664,958 | A | | 5/1987 | Jones |
| 4,699,294 | A | | 10/1987 | Carlin, Jr. |
| 4,706,850 | A | | 11/1987 | Remaks |
| 4,847,028 | A | | 7/1989 | Snyder et al. |
| 4,930,648 | A | | 6/1990 | Hundt |

(Continued)

FOREIGN PATENT DOCUMENTS

DE 26 27 501 12/1976

(Continued)

OTHER PUBLICATIONS

Extended Search Report in corresponding European Application No. 11002974.1.

(Continued)

*Primary Examiner* — Harry Grosso
(74) *Attorney, Agent, or Firm* — Faegre Baker Daniels LLP

(57) ABSTRACT

A bulk storage container includes a tank with a "full drain" outlet, and a coupler attached to the outlet, in which the full drain outlet and coupler utilize a metal-on-metal threaded connection to create a fluid-tight seal therebetween. The polymer coupler includes a metal insert with internal threads, and the tank includes a metal insert with external threads corresponding to the internal threads of the coupler insert. The metal inserts are integrally molded within the walls of the tank and coupler, respectively. Advantageously, the threaded metal inserts provide a rigid structural connection between the tank and coupler that is highly durable and leak resistant. In addition to the threaded fluid-tight seal, a shoulder of the coupler abuts a corresponding face formed on the tank, with a gasket between the shoulder and face to provide a secondary seal.

17 Claims, 7 Drawing Sheets

U.S. PATENT DOCUMENTS

| | | | | |
|---|---|---|---|---|
| 4,994,132 | A | | 2/1991 | Liekens et al. |
| 5,002,202 | A | * | 3/1991 | Karpisek ..... 222/83 |
| 5,135,133 | A | | 8/1992 | Frost |
| 5,158,200 | A | | 10/1992 | Vago et al. |
| 5,161,690 | A | | 11/1992 | Foshaug |
| 5,199,570 | A | | 4/1993 | McKenzie |
| 5,226,558 | A | | 7/1993 | Whitney et al. |
| 5,232,120 | A | | 8/1993 | Dunken et al. |
| 5,266,258 | A | | 11/1993 | Martin |
| 5,374,026 | A | | 12/1994 | Spurrier et al. |
| 5,375,741 | A | * | 12/1994 | Harris ..... 222/105 |
| 5,415,316 | A | | 5/1995 | Pemberton et al. |
| 5,647,732 | A | | 7/1997 | Cali et al. |
| 5,697,515 | A | | 12/1997 | Syler et al. |
| 5,746,344 | A | | 5/1998 | Syler et al. |
| 5,890,616 | A | | 4/1999 | Cravens et al. |
| 5,988,699 | A | | 11/1999 | Quandt |
| 6,079,580 | A | | 6/2000 | Garton et al. |
| 6,096,256 | A | | 8/2000 | Aretz |
| 6,247,594 | B1 | | 6/2001 | Garton |
| 6,626,325 | B1 | | 9/2003 | Humphrey et al. |
| 6,634,676 | B1 | | 10/2003 | Lampson et al. |
| 7,070,725 | B2 | | 7/2006 | Mathew et al. |
| 7,476,354 | B2 | | 1/2009 | Clack |
| 2006/0037695 | A1 | | 2/2006 | Schutz |
| 2009/0008397 | A1 | | 1/2009 | Schmidt et al. |
| 2009/0266821 | A1 | | 10/2009 | Johnson et al. |
| 2009/0294486 | A1 | | 12/2009 | McKnight et al. |

FOREIGN PATENT DOCUMENTS

| | | |
|---|---|---|
| GB | 1 547 262 | 6/1979 |

OTHER PUBLICATIONS

Snyder Industries "SUMO A Tank Outlet System Which Lets You Keep Your Money!", Feb. 2002.

* cited by examiner

METAL INSERT FITTING FOR MATERIAL STORAGE TANKS

CROSS-REFERENCE TO RELATED APPLICATIONS

This application claims the benefit under 35 U.S.C. §119 (e) of U.S. Provisional Patent Application Ser. No. 61/323,146, filed Apr. 12, 2010 and entitled METAL INSERT FITTING FOR POLYETHYLENE TANKS, the entire disclosure of which is hereby expressly incorporated herein by reference.

BACKGROUND

1. Technical Field

The present disclosure relates to material storage containers and, specifically, to drain fittings for material storage containers.

2. Description of the Related Art

Bulk storage containers are commonly utilized for storage and dispensing of flowable materials. In some larger bulk storage containers, a valve may be located near the bottom of the container in order to facilitate controlled, gravity-driven dispensing of the flowable material though the valve, so that the container can be drained without a pump, and with no tilting or moving of the container.

One method of ensuring that substantially all of the flowable material contained within a bulk storage container is dispensable via gravitational forces is to position the tank outlet at the bottom-most portion of the storage tank wall. This "full drain" tank outlet is located adjacent to the bottom of a storage tank, and enables complete drainage of the tank. Full-drain outlets also facilitate "clean in place" procedures in which the tank is thoroughly cleaned at its service location, such as to remove heavy solids or salts that may accumulate at the bottom of the tank during use. Design efforts have focused on allowing clean in place procedures to be accomplished with minimal effort, preferably without the need for a worker to enter the interior of the storage tank being cleaned. Clean in place procedures are particularly useful where tanks must be cleaned between every fill, such as in the pharmaceutical and food industries.

Some bulk storage containers have full drain outlets integrally formed into the wall of the storage container. For example, polymer storage tanks may be manufactured to include an outwardly extending tube or channel at the bottom portion of the tank, which may then be connected to a tank valve to control the flow of flowable material through the tank outlet. However, the location of the integrally formed outlet extension at the bottom of the storage tank renders the outlet extension vulnerable to impact. For example, tank outlet extensions frequently include a flange extending downwardly past the bottom surface of the storage tank, which may be damaged if the tank is placed on a flat surface, i.e., before or during installation at a service site. If a tank outlet extension that is integrally molded or formed into a bulk storage container is damaged, the difficulty of repairing or replacing the integral tank outlet extension may render the tank unusable.

Other bulk storage containers feature removable tank outlet adapters which can be engaged with the wall of a bulk storage container. For example, as shown in FIG. 1, bulk storage container 1 includes an aperture 2 through a wall 3 thereof at a bottom portion of container 1. A threaded insert 4 may be embedded within wall 3 of container 1 to facilitate threaded engagement of an adapter 5 with wall 3. Typically, adapter 5 is made of a polymeric material, such as polyvinyl chloride (PVC) that is resistant to degradation from contact with chemicals or other materials which may be contained within storage container 1. On the other hand, threaded insert 4 is typically made of a metallic material to facilitate a tight engagement between the threads of adapter 5 and threaded insert 4.

However, the polymeric threads of adapter 5 are vulnerable to damage by engagement with the metallic threads of insert 4, such as by overtightening or removal and reinstallation. To minimize leakage of flowable material past a damaged threaded engagement, O-ring 6 is provided at the junction between adapter 5 and tank wall 3. O-ring 6 is also intended to prevent flowable material from engaging with, and potentially chemically degrading, threaded insert 4. In addition, a second O-ring 7 may be provided between adapter 5 and the exterior of tank wall 3 so that, if any flowable material does pass by O-ring 6 and threads 4, 5, leakage of the flowable material may be stemmed by second O-ring 7. However, if flowable material reaches second O-ring 7, the flowable material may attack the metallic material of threaded insert 4 and eventually cause degradation thereof.

SUMMARY

The present disclosure provides a bulk storage container including a tank with a "full drain" outlet, and a coupler attached to the outlet, in which the full drain outlet and coupler utilize a metal-on-metal threaded connection to create a fluid-tight seal therebetween. The polymer coupler includes a metal insert with internal threads, and the tank includes a metal insert with external threads corresponding to the internal threads of the coupler insert. The metal inserts are integrally molded within the walls of the tank and coupler, respectively. Advantageously, the threaded metal inserts provide a rigid structural connection between the tank and coupler that is highly durable and leak resistant. In addition to the threaded fluid-tight seal, a shoulder of the coupler abuts a corresponding face formed on the tank, with a gasket between the shoulder and face to provide a secondary seal.

The portion of the metal insert that is molded within the wall of the tank may include a pair of annular anchoring flanges for firm axial securement of the fitting to the wall. Similarly, the portion of the metal insert that is molded into the coupler may also include anchoring flanges for axial securement. The firm axial securement provided by the anchoring flanges gives the metal inserts ample ability to absorb the axial forces created by the threaded engagement, without allowing the metal inserts to dislodge from their molded-in locations in the tank and coupler. Advantageously, this firm axial securement facilitates a reliable liquid-tight threaded engagement between the metal threads of the tank and coupler inserts.

In one form thereof, the present invention provides a bulk storage container, comprising: a tank having a tank wall made of a polymeric material and a tank floor made of a polymeric material, the tank comprising: a connection area disposed proximate the tank floor, the connection area defining an aperture formed in the tank wall; and a tank insert at least partially integrally molded within the tank wall at the aperture of the connection area, the tank insert having a first exposed metal threaded portion; and a coupler having a bore in fluid communication with the aperture formed in the tank wall, the coupler comprising: a tank connection portion made of a polymeric material, the tank connection portion receivable at the connection area of the tank; and a coupler insert at least partially integrally molded within the tank connection portion, the coupler insert having a second exposed metal threaded portion sized to threadingly engage the first exposed metal threaded portion of the tank insert, whereby the coupler couples with the tank via a metal-on-metal threaded engagement.

In another form thereof, the present invention provides a bulk storage container, comprising: a tank comprising: a tank wall made of a polyethylene material, the tank wall having a substantially uniform thickness; a tank floor made of the same polyethylene material as the tank wall, the tank floor monolithically formed with the tank wall; a connection area disposed at the bottom of the tank wall and adjacent the tank floor, the connection area having an aperture formed in the tank wall with junction material formed around the aperture, the junction material having a junction material thickness greater than the thickness of the tank wall; and a tank insert at least partially integrally molded within the tank wall at the connection area, the tank insert made entirely of metal and having an exposed, externally threaded portion; and a coupler having a bore in fluid communication with the aperture formed in the tank wall, the coupler comprising: a tank connection portion receivable at the connection area; a coupler insert at least partially integrally molded into the tank connection portion, the coupler insert made entirely of metal and having an exposed, internally threaded portion, the internally threaded portion of the coupler insert sized to threadingly, sealingly engage the externally threaded portion of the tank insert; and a flange disposed opposite the tank connection portion, the flange integrally formed with the sized to connect to a flange fitting.

In yet another form thereof, the present invention provides a method of manufacturing a storage tank, comprising: providing a mold defining an internal cavity with a substantially cylindrical mold wall and a substantially flat mold floor; attaching a recess collar to the mold at a junction between the cylindrical mold wall and the mold floor in the internal cavity, the collar extending inwardly from the mold wall and upwardly from the mold floor, the collar having an external shape corresponding to an internal shape of a connection area; attaching a tank insert to the collar such that the tank insert protrudes into the internal cavity of the mold and away from the collar and the mold wall; introducing polymer material into the internal cavity of the mold; rotating the mold while applying heat to the polymer material to coat the mold wall, mold floor and at least one surface of the tank insert with melted polymer material, the rotating step forming the storage tank having a cylindrical tank wall corresponding to the cylindrical mold wall and a substantially flat tank floor corresponding to the substantially flat mold floor, with the tank insert integrally molded into the tank wall adjacent the tank floor; removing the storage tank, tank insert and collar from the mold; and removing the collar from the tank insert to expose an uncoated portion of the tank insert, in which the uncoated portion is entirely within a radial extent of the cylindrical tank wall.

BRIEF DESCRIPTION OF THE DRAWINGS

The above mentioned and other features and advantages of the present disclosure, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplifications set out herein illustrate an exemplary embodiment of the invention and such exemplifications are not to be construed as limiting the scope of the invention in any manner.

DETAILED DESCRIPTION

As indicated above, the present disclosure provides a bulk storage container including a tank and a removable coupler adapted to couple standard-size coupling flanges to the tank. The coupler connects to a full drain tank outlet via a metal-on-metal, fluid-tight, threaded engagement which allows the coupler to be repeatedly assembled and disassembled from the bulk storage container with no loss is sealing effectiveness. A secondary seal is created between an annular shoulder of the coupler and a corresponding face formed in the tank wall. In an exemplary embodiment, the tank includes a male, externally-threaded insert, while the coupler includes a corresponding female, internally-threaded insert.

1. Coupler and Tank with Full Drain Outlet

Figure 2A:
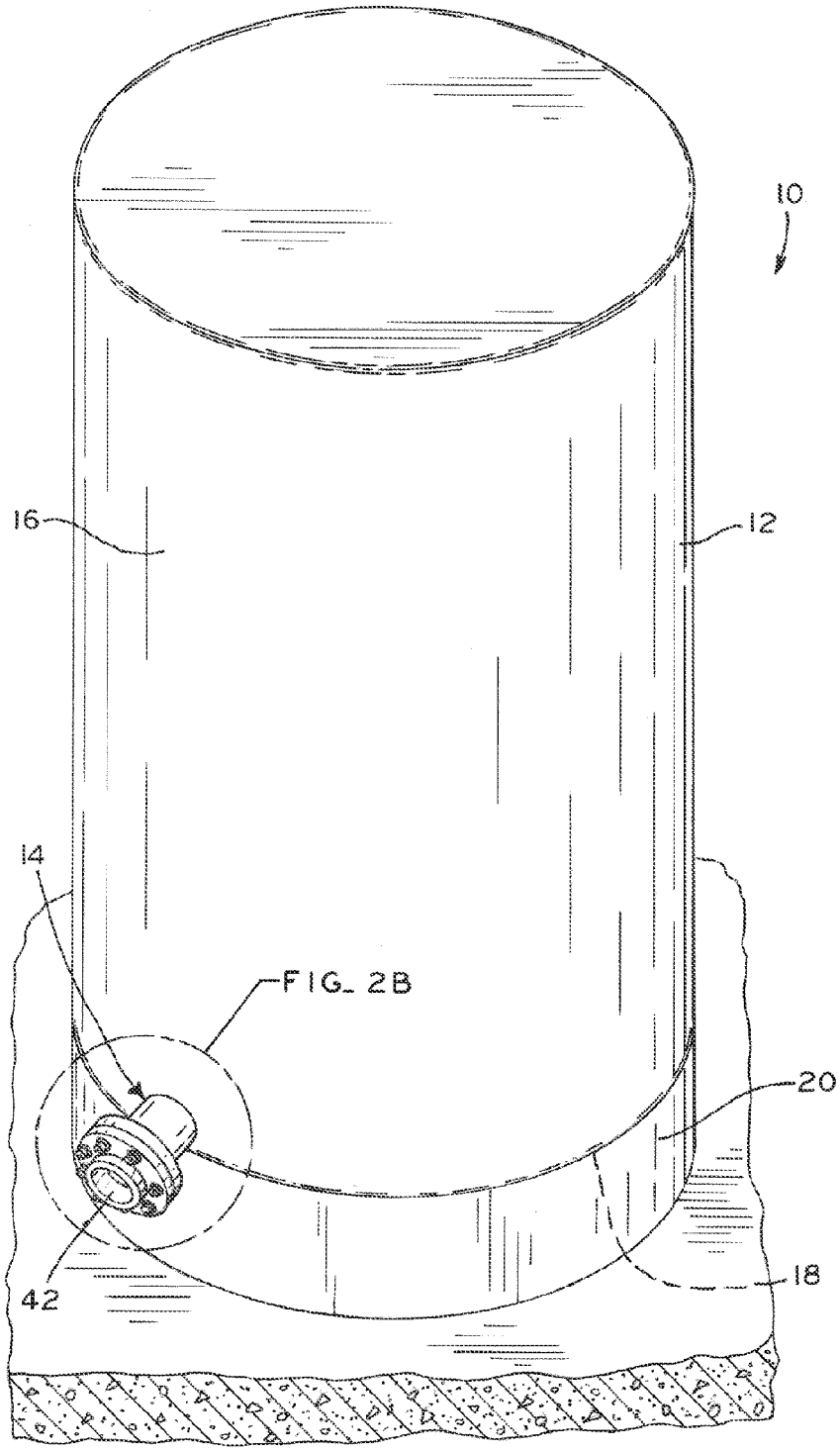
FIG. 2A is a perspective view of a bulk storage container, including a tank with a full drain tank outlet and a connected coupler, in accordance with the present disclosure.

Referring now to FIG. 2A, bulk storage container 10 includes tank 12 with an adapter or coupler 14 extending into tank wall 16 adjacent tank floor 18. In the illustrated exemplary embodiment, tank 12 is formed of a rotationally molded polyethylene, though other polymer materials are contemplated for some applications. The rotational molding process, described in greater detail below, results in all the material of tank 12 being monolithically formed and thereby promotes uniformity and integrity of tank wall 16 and tank floor 18 throughout.

Tank 12 is typically elevated by tank stand 20, which may be a poured concrete podium or metal frame structure, for example, to elevate tank 12 above the ground surface and enable placement of coupler 14 at connection area 22 coincident with tank floor 18. This lowermost placement of coupler 14 facilitates the complete drainage of fluids or flowable materials from tank 12 (i.e., a "full drain" functionality). In one exemplary embodiment, tank stand 20 may be the modular tank stand disclosed in U.S. patent application Ser. No. 13/034,908, entitled "Modular Tank Stand", filed Feb. 25, 2011 and commonly assigned with the present application, the entire disclosure of which is expressly incorporated by reference herein.

In the illustrated embodiment of FIG. 2A, tank 12 is generally cylindrical in shape and adapted to contain a large quantity of flowable material, such as more than 2,500 gallons, or up to 10,000 gallons or more. As such, bulk storage container 10 is generally regarded as a permanent or semi-permanent installation at its service location, in that tank 12 is typically intended to be used, cleaned and serviced without being moved. However, it is within the scope of the present disclosure to form tank 12 in any size or shape as required or desired for a particular application.

Figure 3:
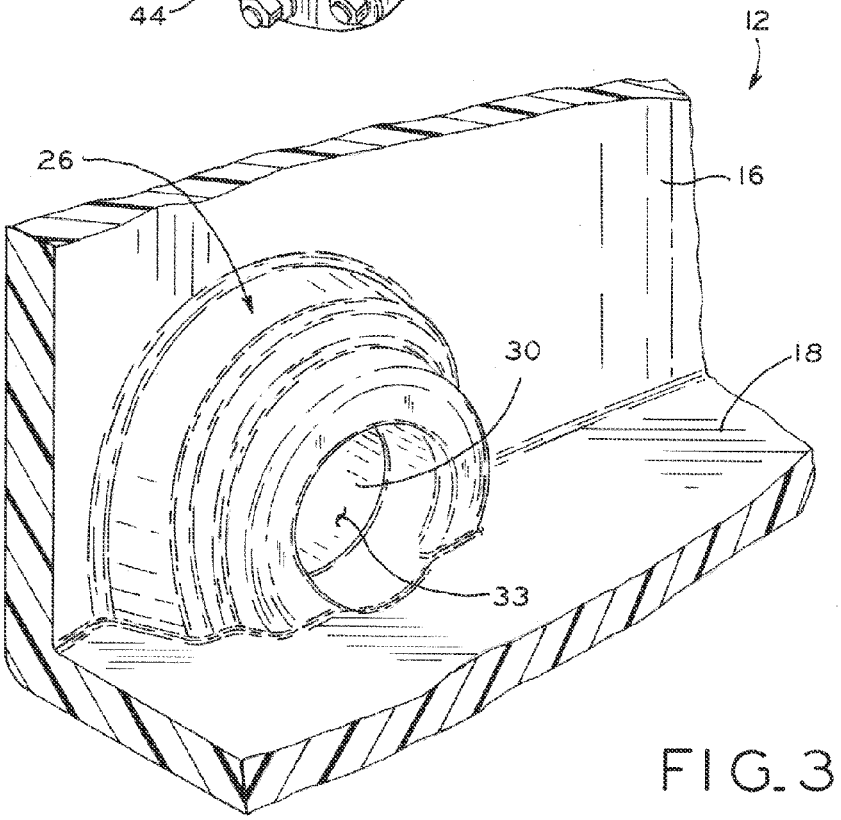
FIG. 3 is a partial, perspective view of the inside of the tank shown in FIG. 2A, illustrating a connection area.
Figure 4A:
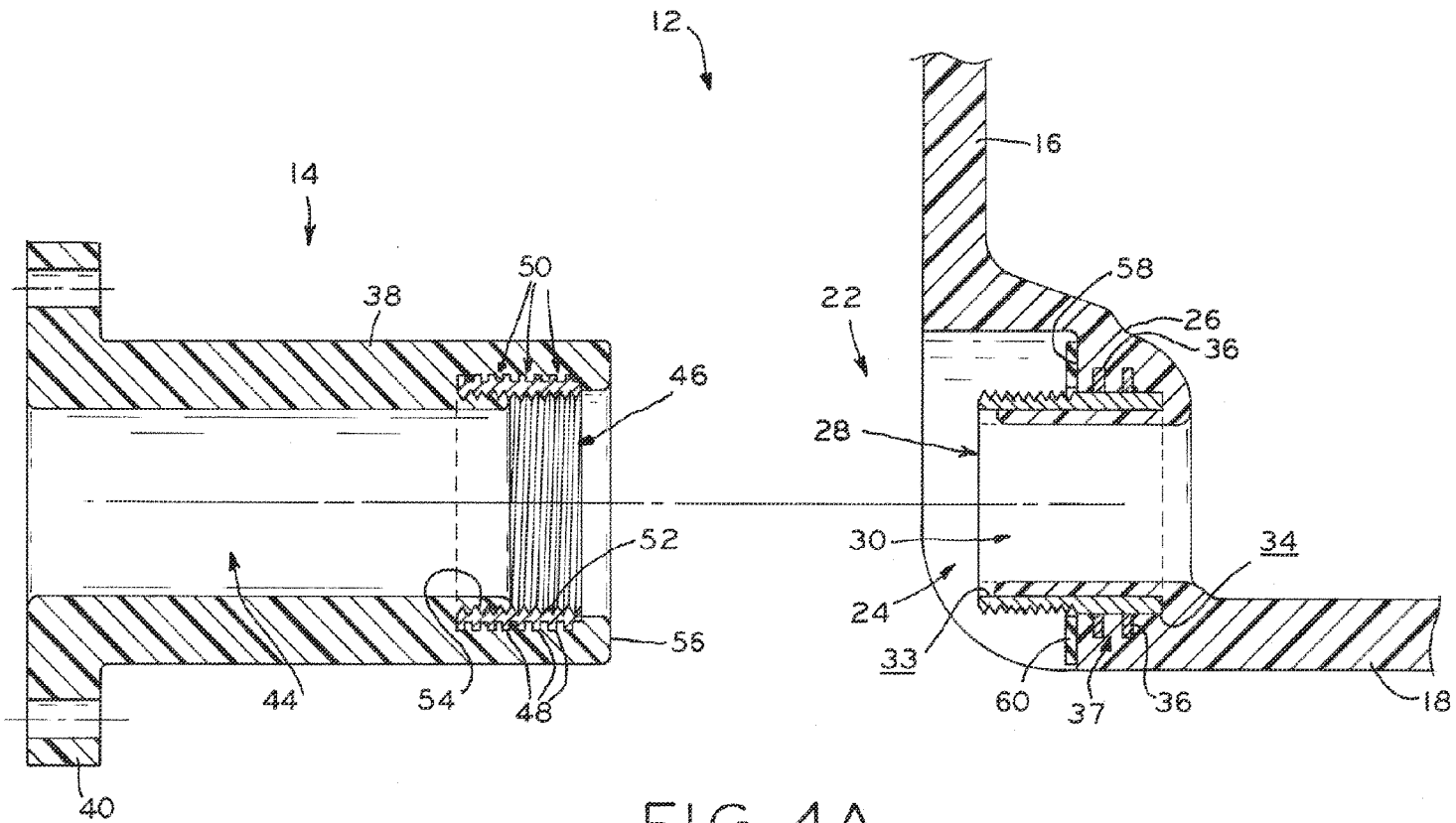
FIG. 4A is an elevation, partial, exploded view of the tank and coupler shown in FIG. 2A.
Figure 4B:
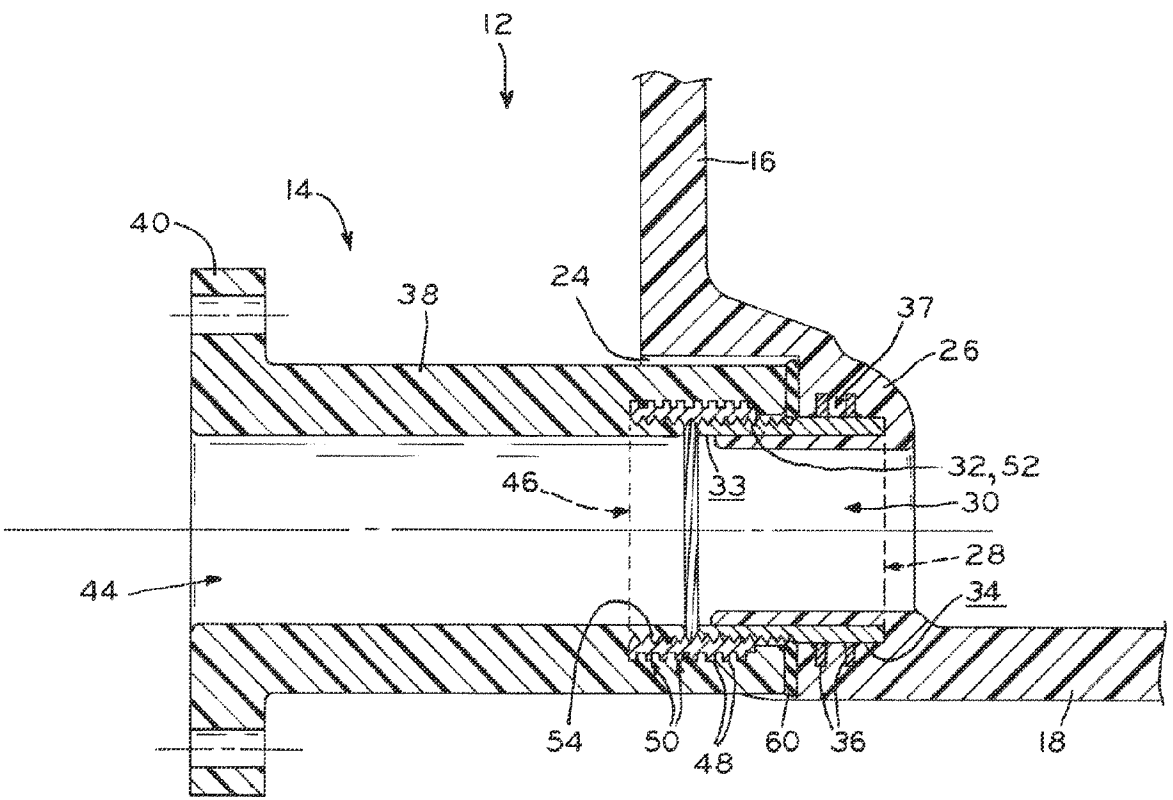
FIG. 4B is an elevation view of the tank and coupler of FIG. 4A, shown with the coupler assembled to the tank.

As best seen in FIGS. 4A and 4B, tank 12 includes connection area 22 adapted to receive coupler 14 (as described in detail below). Connection area 22 includes recess 24 formed at the junction between tank wall 16 and tank floor 18, with junction material 26 (FIGS. 3 and 4) formed around connection area 22 at the inside of tank 12 to maintain continuity of the tank material between tank wall 16 and tank floor 18.

Tank 12 includes tank insert 28, which is a metallic cylindrical structure at least partially embedded within junction material 26, such that flowable material is hermetically contained by tank 12 except for flows into or out of the tank 12 at connection area 22 via bore 30 of tank insert 28. This fixed, sealing engagement between tank insert 28 and tank 12 may be achieved by rotationally molding tank insert 28 within tank 12, as described in detail below.

In the exemplary illustrated embodiment, tank insert 28 has threads formed on its exterior surface at one end thereof, and has a smooth surface at the other end. Exposed threads 32 of tank insert 28 protrude outwardly from junction material 26 and into recess 24, while encased surface 34 is encased in junction material 26. Advantageously, recess 24 allows the exposed portion of tank insert 28 to be contained within the overall profile of tank wall 16 and tank floor 18, thereby protecting tank insert from impact or other damage during transport and setup procedures (described in greater detail below).

Junction material 26 also covers a portion of tank insert 28 within bore 30 near encased surface 34, leaving uncoated surface 33 along a portion of bore 30 near exposed threads 32. In the illustrated embodiment, uncoated surface 33 extends along only a small portion of bore 30, such as about ¼-inch. However, it is contemplated that uncoated surface 33 may extend any distance into bore 30. For connection area 22 with uncoated surface 33, a material may be chosen for tank insert 28 that is not reactive with the material dispensed from tank 12, as discussed below. Alternatively, the entirety of bore 30 may be coated (i.e., surface 33 is fully covered as shown in dashed lines in FIG. 4A), so that flowable material passing through bore 30 does not contact tank insert 28.

Prior to encasing surface 34 within junction material 26, anchor flanges 36 may be axially fixed to tank insert 28, such as by welding to surface 34, to enhance the fixation between tank insert 28 and junction material 26. Alternatively, anchor flanges 36 may be integrally formed with tank insert 28. Anchor flanges 36 impede axial movement of tank insert 28 within junction material 26 because anchor flanges 36 are encased by junction material 26 on all sides, including in gap 37 formed between the pair of anchor flanges 36. The installation of anchor flanges 36 during production of tank 12 is discussed in detail below.

Figure 2B:
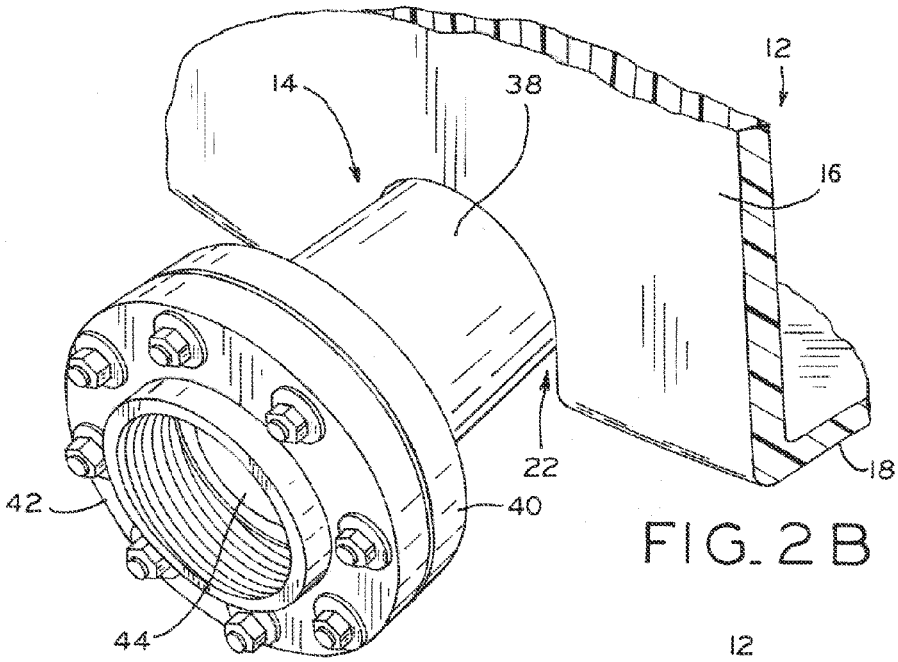
FIG. 2B is a partial, perspective view of the coupler shown in FIG. 2A.

Referring now to FIGS. 2B and 4A, coupler 14 includes a generally cylindrical tank connection portion 38 adapted to be received within recess 24, and flange 40 sized and adapted to connect to flange fitting 42 (FIG. 5), such as an ANSI standard flange fitting, for example (as described in detail below). Bore 44 extends through coupler 14, and is in fluid communication with bore 30 of tank insert 28 when coupler 14 is coupled to tank 12.

Coupler 14 includes coupler insert 46, which is a metallic cylindrical tube at least partially embedded within tank connection portion 38 of coupler 14. As shown in FIGS. 4A and 4B, coupler insert 46 includes a plurality of anchor flanges 48 disposed at an outer portion of coupler insert 46, with the material of tank connection portion 38 filling gaps 50 between respective pairs of anchor flanges 48. Similarly to anchor flanges 36 of tank insert 28, anchor flanges 48 aid in the firm axial fixation of coupler insert 46 within the material of coupler 14.

Tank connection portion 38 further includes exposed threads 52 and encased threads 54. Exposed threads 52 are sized and adapted to engage exposed threads 32 of tank insert 28 to join coupler 14 to tank 12, as discussed in detail below. In an exemplary embodiment, the geometry (i.e., thread pitch, depth, taper, etc) of threads 32, 52 conforms to national pipe thread (NPT) standards, so that standard parts may be used in conjunction with tank 12 and/or coupler 14 Encased threads 54 are covered over with the material of coupler 14 during the production thereof, to further enhance the firm fixation of coupler insert 46 within coupler 14. In an alternative embodiment, encased threads 54 may be a smooth surface, similar to encased surface 34 of tank insert 28.

Figure 5:
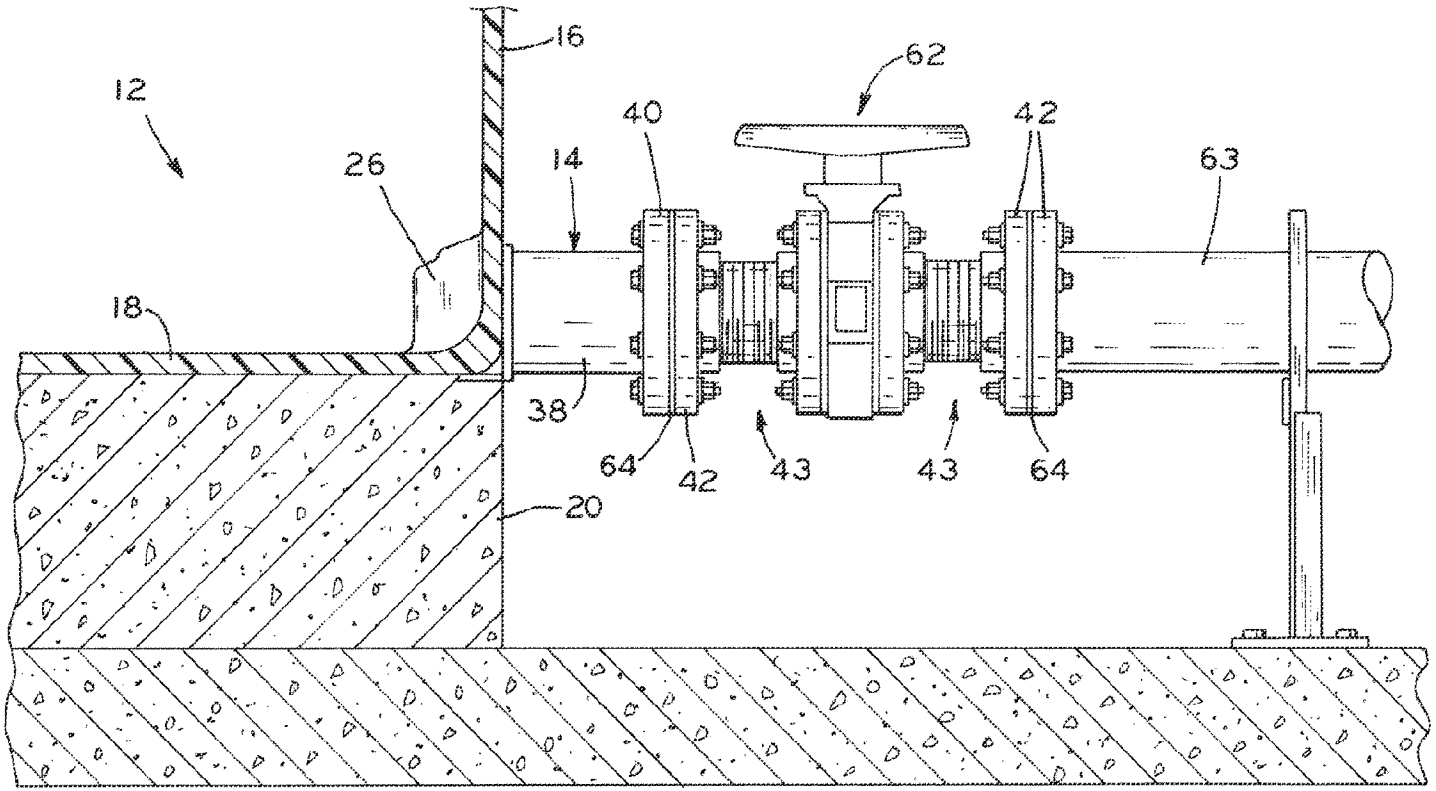
FIG. 5 is an elevation, partial view of the tank and coupler of FIG. 2A, illustrating the coupler connected to a valve assembly.

As best seen in FIG. 5, flange 40 of coupler 14 is a substantially solid structure integrally formed with tank connection portion 38, and has a diameter sized to accept the connection of valves, pipes, or the like to coupler 14 via flange fitting 42. In an exemplary embodiment, flange 40 and tank connection portion 38 are formed as a single, unitary and monolithic structure made of a polymeric material, such as polyethylene. For example, coupler 14 may be produced by a molding process to mold both flange 40 and tank connection portion 38 simultaneously, with tank connection portion 38 being molded over coupler insert 46 (FIG. 4A), such that all the polymeric material of coupler 14 is formed as a single, monolithic unit.

In the illustrated embodiment, coupler 14 is made of the same polyethylene material as tank 12, though it is contemplated that other materials may be used. In one alternative embodiment, coupler 14 may be made from a relatively soft, pliable, low-durometer PVC, so that coupler 14 can be used as an expansion joint. Advantageously, this "expansion joint" embodiment of coupler 14 is able to cope with a variety of adverse conditions, such as thermal variability, vibration, seismic activity, deflections of the joint, and the like.

Tank insert 28 and coupler insert 46 may be formed from any suitable metallic material as desired or required for a particular design. The material used for metal inserts 28, 46 may vary depending upon the material to be stored in bulk storage container 10. In certain exemplary embodiments, metal inserts 28, 46 may be made of stainless steel (such as 316 stainless steel), Hastelloy® C-276 ("Hastelloy" is a registered trademark of Haynes International, Inc. of Kokomo, Indiana), or titanium, for example. Advantageously, these materials are resistant to degradation from contact with a wide variety of liquid or granular chemicals, making bulk storage container 10 adaptable to a wide variety of bulk storage needs. Moreover, different materials are suitable for use in conjunction with different chemicals depending on whether a chemical reaction occurs between the chemical and the metal. It is within the scope of the present disclosure that any suitable metallic or non-metallic material may be used for inserts 28, 46 as required or desired for a particular application.

2. Assembly and Use of the Bulk Storage Container

In use, coupler 14 may be threadably attached to tank 12 using metal inserts 28, 46 to provide a rigid and fluid-tight structural connection between tank 12 and coupler 14. Referring to FIGS. 2B and 4B, tank connection portion 38 of coupler 14 is sized to be received within recess 24 of tank 12.

The threaded engagement between exposed threads 32, 52 forms a primary liquid tight seal against leakage of flowable material from tank 12. To further enhance the impermeability of the thread-to-thread engagement, conventional thread sealing materials may be applied between threads 32, 52, such as polytetrafluoroethylene (PTFE) film or other pipe thread sealing materials.

Exposed threads 52 of coupler insert 46 are engaged with exposed threads 32 of tank insert 28 to threadably attach coupler 14 to tank 12. Once the threaded engagement is advanced sufficiently far, shoulder 56 of coupler 14 contacts sealing surface 58 of connection area 22, with gasket 60 disposed therebetween. Further threaded engagement compresses gasket 60 to provide a secondary liquid tight, resilient seal between shoulder 56 and sealing surface 58. Thus, gasket 60 facilitates and provides two separate sealing mechanisms: first, the resilient compression of gasket 60 provides tension between threads 32, 52 to aid in the sealing engagement at the metallic threaded connection; second, gasket 60 independently provides a separate, secondary liquid tight sealing engagement between tank 12 and coupler 14.

Advantageously, the firm axial fixation of metal inserts 28, 46 provided by anchor flanges 36, 48, respectively, allows a tight threaded engagement between tank 12 and coupler 14. This tight threaded engagement further ensures that a fluid tight seal is formed between bore 30 of tank insert 28 and bore 44 of coupler 14. Thus, flowable material contained by bulk storage container 10 is prevented from leaking out at connection area 22, even after repeated uses or in a harsh service environment.

With coupler 14 firmly secured to tank 12, other "downstream" structures may be affixed to coupler 14 for further control and routing of flowable material drained from tank 12. Referring to FIG. 5, one such structure is valve 62, which may be used to control the flow rate of flowable material as it is drained from tank 12, or may be used to prevent any flow of flowable material therethrough. In the illustrated embodiment, valve 62 is connected to coupler 14 via expansion joint 43, which includes flange fittings 42 at either end thereof. Additionally, tubing 63 may be attached to valve 62 via a second expansion joint 43 to further direct flowable material to any desired location. Moreover, because flange 40 of coupler 14 is adapted to receive a standard flange fitting 42, any number of standard fluid control and routing devices and structures may be coupled to bulk storage container 10. As shown in FIG. 5, flange gasket 64 may be disposed between flange 40 and flange fitting 42 to ensure a fluid tight seal therebetween.

Figure 1:
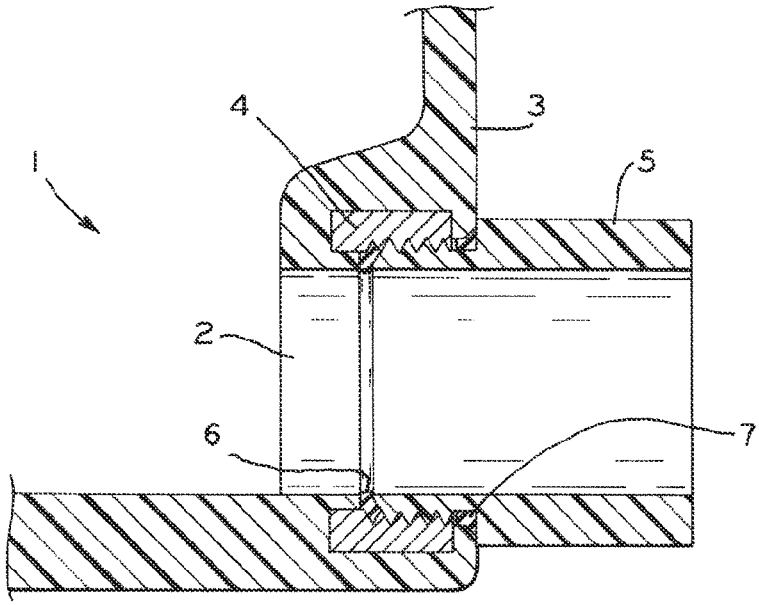
FIG 1 PRIOR ART
FIG. 1 is an elevation, section view of a known full drain tank outlet assembly.

Advantageously, coupler 14 is fully replaceable, and can be removed or installed multiple times without compromising the ability to create a fluid-tight seal between coupler 14 and tank 12. For example, tank 12 may be installed at its service location (such as upon a tank stand 20, shown in FIG. 1) with coupler 14 not connected, to prevent any potential for damage to coupler 14 during the initial positioning of tank 12. Coupler 14 can then be installed once tank 12 is properly positioned.

Also advantageously, the metal-on-metal engagement between tank insert 28 and coupler insert 46 ensures that exposed threads 32, 52, respectively, have the same or similar strength characteristics. Thus, threads 32, 52 avoid damage to one set of threads by the other set of threads, such as from the application of force during the process of connecting coupler 14 to tank 12. Further, coupler 14 can be removed and replaced on tank 12 multiple times without damage or significant wear to exposed threads 32 and/or 52.

This metal-on-metal engagement also allows coupler 14 to modularly attach and/or re-attach to any number of bulk storage containers including insert 28. Threads 32, 52 are not significantly deformed by connecting coupler 14 to tank 12, and therefore do not become "individualized" by conforming to the particular thread profile of their first attachment. Thus, coupler 14 may be removed from one tank 12, and attached to any other similarly configured tank 12 with no loss in sealing effectiveness. Advantageously, the modularity afforded by the metal-on-metal thread engagement of the present disclosure allows one part of a coupler/tank assembly to be replaced individually in the event of chemical or mechanical damage, while preserving the other, undamaged part of the assembly.

In an alternative embodiment, coupler 14 may be eliminated. Instead, a flexible hose (not shown), such as a traditional braided hose used for conveying fluids, may be connected directly to tank 12 via threaded engagement with exposed threads 32 of tank insert 28. Moreover, because tank insert 28 is made of metal, threads 32 may be sized to connect directly to a variety of traditional metal couplings for a fluid-tight metal-on-metal seal with such couplings.

3. Method of Manufacturing Bulk Storage Container

In an exemplary embodiment, and as noted above, tank 12 and coupler 14 are primarily comprised of polyethylene. Polyethylene is resistant to degradation by many of the chemicals and substances which may be stored within bulk storage container 10, while also having a high degree of structural integrity and damage resistance. In addition, polyethylene may be heated into a flowable state during various molding processes to achieve final products with complex shapes and geometries, such as the cylindrical shape of tank 12 and the complex shape of recess 24 and junction material 26.

Figure 6:
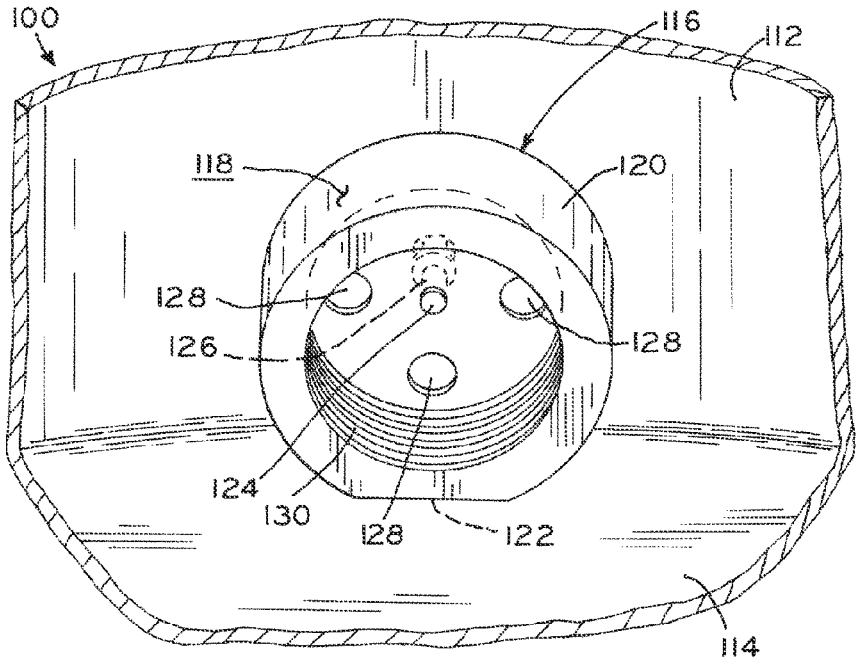
FIG. 6 is a perspective view of the inside of a tank mold in accordance with the present disclosure, illustrating a collar for creating a recess in the container wall.
Figure 7:
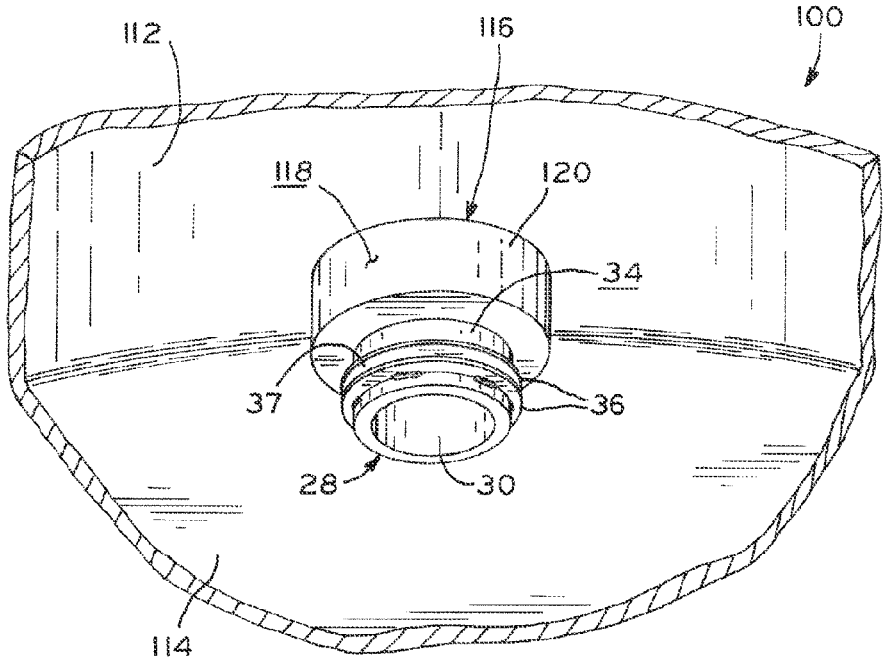
FIG. 7 is a perspective view of the tank mold shown in FIG. 6, with a tank insert threaded into the collar shown in FIG. 6.

In one exemplary embodiment, for example, tank 12 is produced by a rotational molding process to achieve a substantially uniform wall thickness and a desired profile for junction material 26. Referring now to FIGS. 6 and 7, mold 100 has a substantially cylindrical shape with an internal cavity including arcuate wall 112 and a flat floor 114. Wall 112 and floor 114 correspond to the shapes of tank wall 16 and tank floor 18, respectively. Tank 12 is formed within mold 100 by introducing polyethylene into mold 100 and rotating mold 100 to evenly coat the surfaces therein, including wall 112 and floor 114. Mold 100 is heated during the molding process to melt the polyethylene into a flowable state.

Connection area 22 is formed during the rotational molding process by coupling recess collar 116 to mold wall 112 and threadably engaging tank insert 28 to recess collar 116. As best seen in FIG. 6, recess collar 116 has outer surface 118 which corresponds to the geometry of recess 24 in tank 12. Outer surface 118 includes a generally cylindrical portion 120 and flat portion 122. When assembled to tank mold 100, cylindrical portion 120 extends upwardly along mold wall 112 and away from mold floor 114, while flat portion 122 extends inwardly away from mold wall 112 and abuts mold floor 114. Flat portion 122 may be curved along the axial extent of recess collar 116 to match the radiused junction between mold wall 112 and mold floor 114.

Referring to FIG. 6, recess collar 116 is affixed to mold wall 112 by attachment bolt 124, which passes through a hole (not shown) formed in mold wall 112 and threadably engages threaded central aperture 126 formed in recess collar 116. Thus, tightening bolt 124 draws recess collar 116 tightly against mold wall 112 and secures the same thereto, so that recess collar is retained in the desired position throughout the rotational molding process.

Recess collar 116 further includes a plurality of heat sinks 128 integrally formed therein to facilitate the transfer of heat through recess collar 116 during the molding and curing processes. Advantageously, heat sinks 128 can be used to transfer additional heat to connection area 22 of tank 12 (FIG. 4A) during the molding operation, which attracts extra material to junction material 26 of tank 12 (FIG. 4A) and increases the thickness of junction material 26 relative to the thicknesses of tank wall 16 and tank floor 18. Heat sinks 128 can be increased or decreased in number or size to attract an appropriate amount of junction material 26 to tank 12, as required or desired. Further, heat sinks 128 facilitate a rate of cooling of junction material 26 that is commensurate with the rate of cooling of tank wall 16 and tank floor 18 after the molding process, thus ensuring uniform material properties throughout tank 12 after curing.

Referring now to FIG. 7, with recess collar 116 securely affixed to tank mold 100, tank insert 28 may be threadably engaged with threads 130 formed in recess collar 116 to couple tank insert 28 with recess collar 116 prior to the molding process. Anchor flanges 36 are then mated to encased surface 34 (i.e., by welding), with suitable spacing therebetween to ensure complete infiltration of polyethylene into gap 37, as well as thorough encasement of encased surface 34 and anchor flanges 36 during the molding process. Prior to initiating the molding process, a plug (not shown) coated with a low-friction material such as Teflon® ("Teflon" is a registered trademark of E. I. du Pont de Nemours and Company of Wilmington, Del.) is inserted into bore 36 of tank insert near exposed threads 32. The plug prevents heated polyethylene from flowing entirely through bore 30 of tank insert 28, creating uncoated surface 33 as discussed above.

With recess collar 116 and tank insert 28 assembled with tank mold 100, polyethylene is introduced into mold 100, and mold 100 is heated and rotated to evenly coat melted polyethylene on all surfaces at the interior of mold 100. As best seen in FIGS. 4A and 4B, some buildup of junction material 26 occurs around junction material 26 as a result of extra heat flow via heat sinks 128 (as discussed above and shown in FIG. 5). Advantageously, this extra buildup of polyethylene material around anchor flanges 36 and tank insert 28 ensure high strength at connection area 22 and firm axial fixation of tank insert 28 within recess 24.

After the polyethylene is cured within the cavity of mold 100, the completed tank 12 is removed together with tank insert 28 (which is now integrally molded into the material of tank 12) and recess collar 116. Recess collar 116 is then removed from tank insert 28, exposing uncoated threads 32. Because recess collar 116 protrudes inwardly and upwardly from the otherwise continuous wall 112 and floor 114 surfaces, tank insert 28 is contained within recess 24 and does not extend either outwardly beyond the radial extent of tank wall 16, nor downwardly beyond the vertical extent of tank floor 18. In this way, tank insert 28 is protected from impact within recess 24, as discussed in detail above.

While this invention has been described as having an exemplary design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A bulk storage container, comprising:

a tank having a tank wall made of a polymeric material and a tank floor made of a polymeric material, said tank comprising:

a connection area disposed proximate said tank floor, said connection area defining an aperture formed in said tank wall; and a tank insert at least partially integrally molded within said tank wall at said aperture of said connection area, said tank insert having a first exposed metal threaded portion; and a coupler having a bore in fluid communication with said aperture formed in said tank wall, said coupler comprising:

a tank connection portion made of a polymeric material, said tank connection portion receivable at said connection area of said tank; and a coupler insert at least partially integrally molded within said tank connection portion, said coupler insert having a second exposed metal threaded portion sized to threadingly engage said first exposed metal threaded portion of said tank insert, whereby said coupler couples with said tank via a metal-on-metal threaded engagement.

2. The bulk storage container of claim 1, wherein said first exposed metal threaded portion of said tank insert is disposed on an external surface of said tank insert, and said second exposed metal threaded portion of said coupler insert is disposed on an internal surface of said coupler insert, whereby said tank comprises a male thread and said coupler comprises a female thread.

3. The bulk storage container of claim 1, wherein said coupler includes a flange disposed opposite said tank connection portion, said flange made of the same polymeric material as said tank connection portion and integrally formed with said tank connection portion, said flange sized to connect to a flange fitting.

4. The bulk storage container of claim 3, in combination with a tank stand disposed underneath said tank, said tank stand elevating said tank above a ground surface, said flange of said coupler extending below said tank floor toward the ground surface, whereby said tank stand facilitates a complete drainage of fluids or flowable materials from said tank.

5. The bulk storage container of claim 1, wherein said tank is generally cylindrical in shape and sized to contain at least 2,500 gallons.

6. The bulk storage container of claim 1, wherein at least one of said tank and said coupler is made of polyethylene.

7. The bulk storage container of claim 6, wherein at least one of said tank and said coupler is monolithically formed.

8. The bulk storage container of claim 1, wherein said tank wall defines a substantially uniform tank wall thickness, said tank wall including junction material formed around said connection area, said junction material having a junction material thickness greater than said wall thickness.

9. The bulk storage container of claim 1, wherein said coupler insert is made entirely of metal, said coupler insert including an insert bore forming at least part of said bore of said coupler, said insert bore at least partially coated with the polymeric material of said tank connection portion.

10. The bulk storage container of claim 1, wherein said tank insert is made entirely of metal, said tank insert including a tank insert bore spanning said aperture formed in said tank wall, said tank insert bore at least partially coated with the polymeric material of said tank wall.

11. The bulk storage container of claim 1, wherein said tank insert includes anchor flanges axially fixed to said tank insert, said anchor flanges including gaps therebetween, said gaps filled with the polymeric material of said tank wall.

12. The bulk storage container of claim 1, wherein said coupler insert includes anchor flanges axially fixed to said coupler insert, said anchor flanges including gaps therebetween, said gaps filled with the polymeric material of said tank connection portion.

13. The bulk storage container of claim 1, wherein at least one of said coupler insert and said tank insert is made from one of stainless steel, Hastelloy® C-276, and titanium.

14. A bulk storage container, comprising:

a tank comprising:

a tank wall made of a polyethylene material, said tank wall having a substantially uniform thickness;

a tank floor made of the same polyethylene material as said tank wall, said tank floor monolithically formed with said tank wall;

a connection area disposed at the bottom of said tank wall and adjacent said tank floor, said connection area having an aperture formed in said tank wall with junction material formed around said aperture, said junction material having a junction material thickness greater than said thickness of said tank wall; and a tank insert at least partially integrally molded within said tank wall at said connection area, said tank insert made entirely of metal and having an exposed, externally threaded portion; and a coupler having a bore in fluid communication with said aperture formed in said tank wall, said coupler comprising:

a tank connection portion receivable at said connection area;

a coupler insert at least partially integrally molded into said tank connection portion, said coupler insert made entirely of metal and having an exposed, internally threaded portion, said internally threaded portion of said coupler insert sized to threadingly, sealingly engage said externally threaded portion of said tank insert; and a flange disposed opposite said tank connection portion, said flange integrally formed with said sized to connect to a flange fitting.

15. The bulk storage container of claim 14, in combination with a tank stand disposed underneath said tank, said tank stand elevating said tank above a ground surface, said flange of said coupler extending below said tank floor toward the ground surface, whereby said tank stand facilitates a complete drainage of fluids or flowable materials from said tank.

16. The bulk storage container of claim 14, wherein said tank is generally cylindrical in shape and sized to contain at least 2,500 gallons.

17. The bulk storage container of claim 14, wherein at least one of said coupler insert and said tank insert is made from one of stainless steel, Hastelloy® C-276, and titanium.

* * * * *